US005313898A

United States Patent [19]

Ishibashi

[11] Patent Number: 5,313,898

[45] Date of Patent: May 24, 1994

[54] AUTOMATIC SEWING APPARATUS

[75] Inventor: Shinji Ishibashi, Shimane, Japan

[73] Assignee: Pegasus Sewing Machine Mfg. Co., Ltd., Osaka, Japan

[21] Appl. No.: 912,901

[22] Filed: Jul. 13, 1992

[30] Foreign Application Priority Data

Jul. 11, 1991 [JP] Japan ..... 3-171069

[51] Int. Cl.[5] ..... D05B 35/02

[52] U.S. Cl. ..... 112/141

[58] Field of Search ..... 112/121.12, 121.15, 112/141, 147, 262.3, 143, 440

[56] References Cited

U.S. PATENT DOCUMENTS

| | | | |
|---|---|---|---|
| 3,105,973 | 10/1963 | Stiefelmeier | 112/147 X |
| 3,875,881 | 4/1975 | Marforio | 112/141 X |
| 4,892,049 | 1/1990 | Hiramatsu et al. | 112/262.3 X |
| 4,947,771 | 8/1990 | Miyachi et al. | 112/147 X |
| 4,996,933 | 3/1991 | Boser | 112/147 X |

FOREIGN PATENT DOCUMENTS

| | | |
|---|---|---|
| 2-277491 | 11/1990 | Japan . |
| 3-7374 | 1/1991 | Japan . |

*Primary Examiner*—Clifford D. Crowder
*Assistant Examiner*—Paul C. Lewis
*Attorney, Agent, or Firm*—Wegner, Cantor, Mueller & Player

[57] ABSTRACT

An automatic sewing apparatus is disclosed for sewing together a pair of first edges of two overlapped bodies by a cross seam, each of the bodies being formed by sewing together a pair of second edges of two pieces of overlapped cloth, wherein the two bodies are layered with the margins to the seam of the second edges facing away from each other, and the apparatus comprising a sewing device for sewing the overlapped bodies together, a table for supporting the bodies to be sewn, and a sewn edge fold-down device for folding down the margin of one of the bodies in the direction to feed the cloth, and the margin of the other body in the opposite direction before sewing the first edges.

11 Claims, 17 Drawing Sheets

AUTOMATIC SEWING APPARATUS

BACKGROUND OF THE INVENTION (1) Field of the Invention

This invention relates to an automatic sewing apparatus for sewing the crotch of unfinished trousers and the like. In the sewing of such trousers, the crotch and both sides are each combined by a cross seam, with a front body into which a right front body and a left front body are formed being overlapped with a back body into which a right back body and a left back body are formed.

(2) Description of the Related Art

FIG. 1 shows a pair of unfinished trousers 99 as an example of sewn products. Right and left front bodies 100*a*/100*b* are formed into a front body 100 by stitching a line $\alpha$, and a right and left back bodies 101*a*/101*b* are formed into a back body 101 by stitching a line $\beta$. Both lines $\alpha/\beta$ are formed by a plain seam (Federal Standard No. 751a Seam Type SSa). The front and back bodies have been combined by seaming both sides, only the crotch $\gamma$ being left unsewn.

Conventional auto sewing apparatuses for sewing the crotch $\gamma$ of a pair of unfinished trousers comprise a table 102, a sewing mechanism unit 103, a first hand 104, a second hand 105, and a third hand 106 as shown in FIG. 2 (Refer to Japanese Laid-open Patent Application No. 2-277491 and Japanese Laid-Open Utility Model No. 3-7374).

The sewing mechanism unit 103, like an ordinary sewing machine, comprises a needle, a presser foot, a cloth feed mechanism unit, and a thread cutter.

The first hand 104 includes a guide mechanism unit having a guide edge having a certain angle. The hand 104 guides the trousers 99 to the sewing mechanism unit 103 by holding the bottom of a leg of the trousers 99 on the table 102, with a pair of edges extending from the bottom of one leg to the center of the crotch being overlapped.

The second hand 105 includes a hold mechanism unit for holding the crotch, with the above-mentioned a pair of the edges including the ends A/B of the stitching lines $\alpha/\beta$ being overlapped, as well as a follow mechanism unit for following the trousers 99 transferred by the sewing operation of the sewing mechanism unit 103. The hold mechanism unit keeps holding the trousers 99 until the second hand 105 moves to a position just before the sewing mechanism unit 103 in the direction of the arrow in FIG. 3. The hand 105 includes a guide mechanism, as the first hand 104, which guides the trousers 99 to the sewing mechanism unit 103 by holding the bottom of the other leg of the trousers 99, with a pair of edges extending from the center of the crotch to the bottom of the other leg being overlapped.

The third hand 106 having almost the same construction as the second hand 105 holds the bottom of the other leg of the trousers 99 and follows the trousers 99 transferred in the direction of the arrow by the sewing operation of the sewing mechanism unit 103.

However, such conventional auto sewing apparatuses have some problems: when such trousers are sewn, a total of six layers of cloth should be sewn together in the intersecting portion of the line $\alpha$, the line $\beta$, and the crotch $\gamma$, which often damages the apparatus or deteriorates the quality of finished products.

As shown in FIG. 4, the above six layers of cloth results from the standing end A of the right/left front bodies 100*a*/100*b* being folded down in the same direction as the end B of the right/left back bodies 101*a*/101*b* by a presser foot 110.

Although the stitching line over the six-layered cloth is rather short, it may still damage the sewing mechanism unit 103 because the load applied on it is suddenly increased by the tripled thickness, compared to the other portions.

Furthermore, after the end A is folded down, if the transfer of the cloth is checked by the force of the presser foot 110, the ends A and B slip from each other in the sewing direction. Consequently, in a pair of finished trousers, as shown in FIG. 5, the stitching line $\alpha$ of the front body and the line $\beta$ of the back body do not overlap, resulting in bad appearance and uncomfortable fitting.

The hold mechanism unit of the second hand 105 is useless to prevent such cloth slipping because it holds the trousers 99 only until the ends A/B are transferred to just before the sewing mechanism unit 103 as previously mentioned.

The slipping may be prevented by intensifying the cloth transfer force of the upper feed dog 111 of the sewing mechanism unit 103 more than the resistance of the presser foot 110. However, this can not be carried out to prevent cloth from being spoiled.

SUMMARY OF THE INVENTION

The object of this invention is to provide an automatic sewing apparatus by which two bodies, each formed by stitching two pieces of cloth together, are overlapped and sewn together without a portion where six strata of the cloth is layered, and by which consequently damage of the apparatus and deterioration of the quality of the finished sewn product can be prevented.

The above object can be achieved by an automatic sewing apparatus used for sewing together a pair of first edges of overlapped two bodies each formed by sewing together a pair of second edges of two pieces of overlapped cloth, wherein each pair of the hems is adjacent to each other, with substantially coincided corners at which the first and second edges cross each other and the two bodies are layered with margins to the seam of the second edges outward, and the apparatus being characterized by comprising a sewing device for sewing the first edges, a table for laying the bodies to be sewn, and a sewn edge fold-down device for folding down the corner of one of the bodies in the direction to feed the cloth, and the corner of the other body in the opposite direction before sewing the first edges.

According to such a construction, the cloth is fed to the sewing means by the corner fold-down means for folding down the corners in the opposite directions from each other, therefore, the number of the layered cloth to be sewn together is lessened to at most four. Such a lessening of the thickness of the cloth serves to reduce the load applied on the sewing mechanism unit. Moreover, the reduced transfer resistance serves to check the slip of the corners.

Consequently, in sewing operation of unfinished trousers, both stitching lines of the right/left front bodies and of the right/left back bodies are overlapped. As a result, trousers with good appearance and comfortable fitting can be provided.

This invention is widely applicable for making a cross seam without being limited to this embodiment. For example, it can be used in the case of seaming arms and an upper garment.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENT

Overall construction of the automatic sewing apparatus

Figure 1:
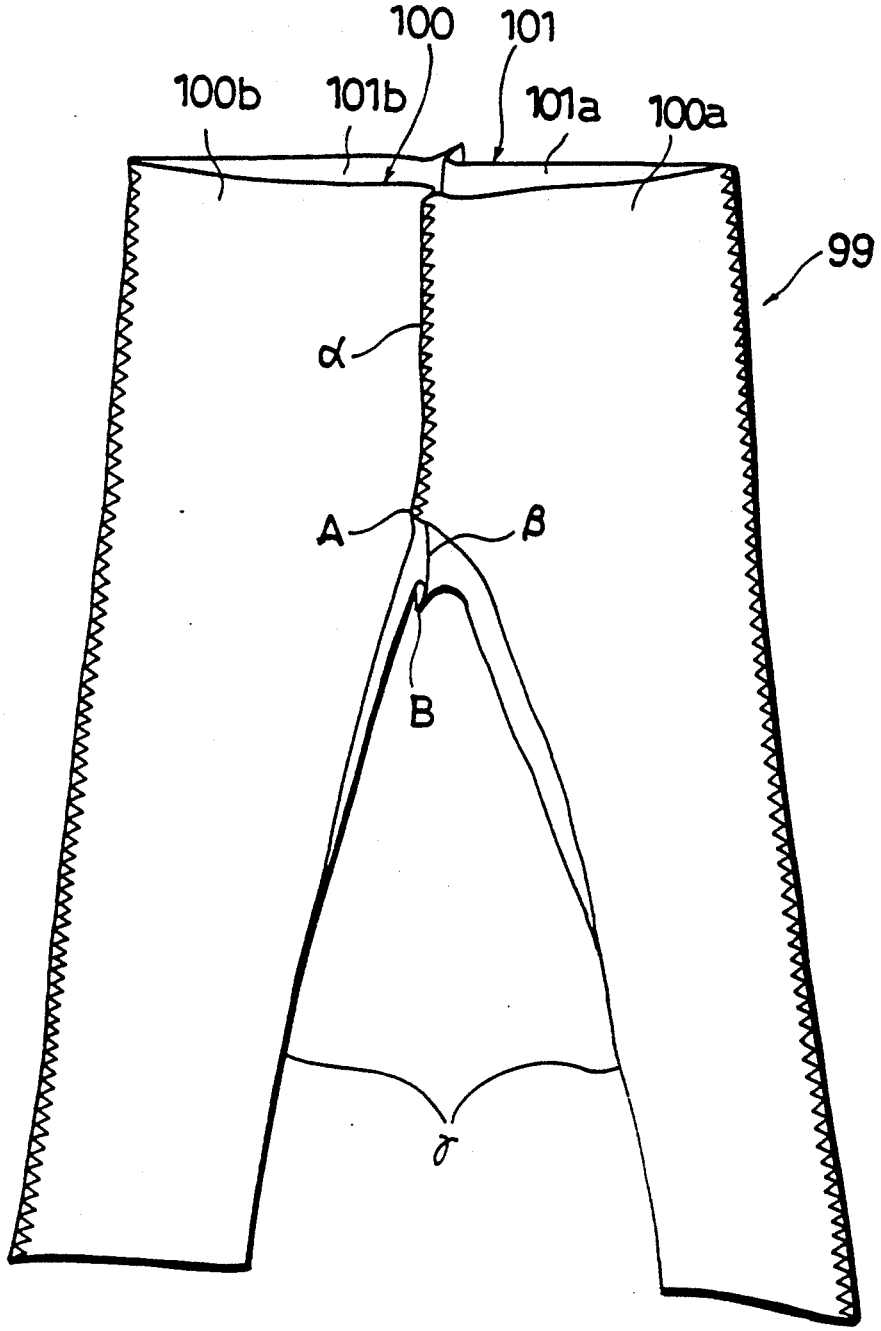
FIG. 1 Related Art
FIG. 1 is an illustration of a pair of unfinished trousers as a sewn product.
Figure 2:
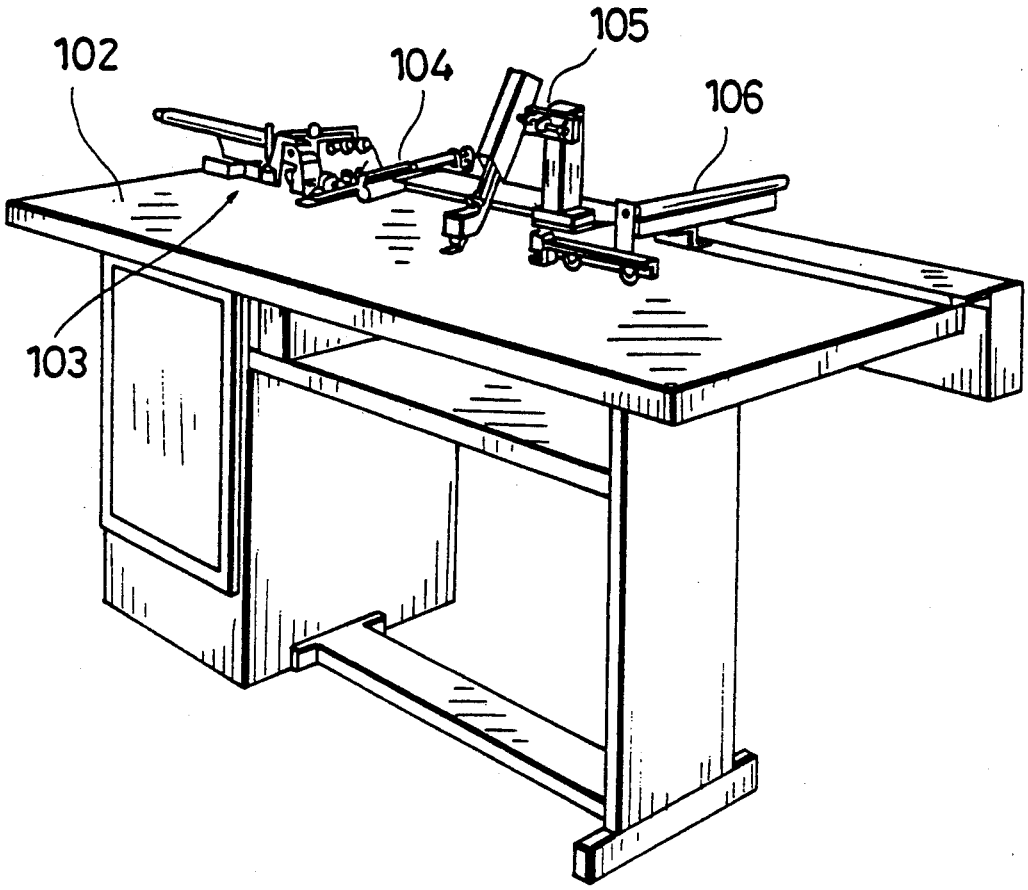
FIG. 2 Related Art
FIG. 2 is a perspective view of a conventional automatic sewing apparatus.
Figure 3:
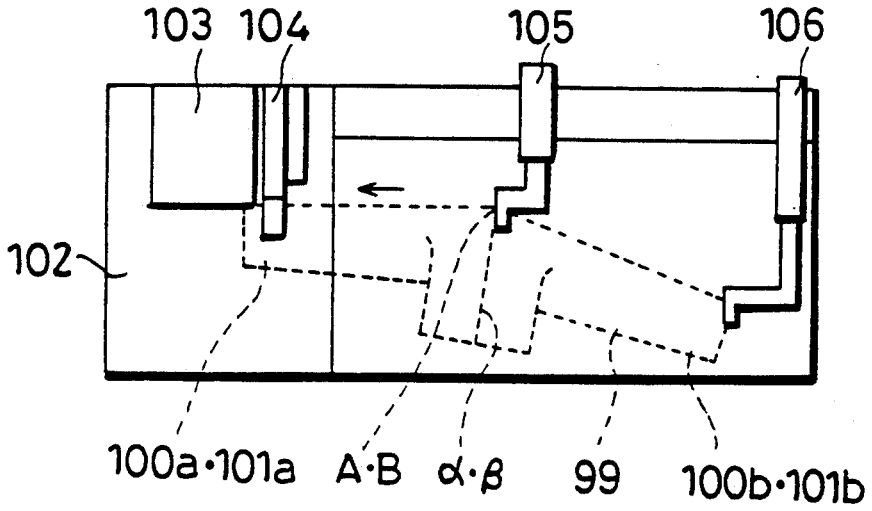
FIG. 3 Related Art
FIG. 3 is an illustration of the conventional automatic sewing apparatus on which the unfinished trousers is being set.
Figure 4:
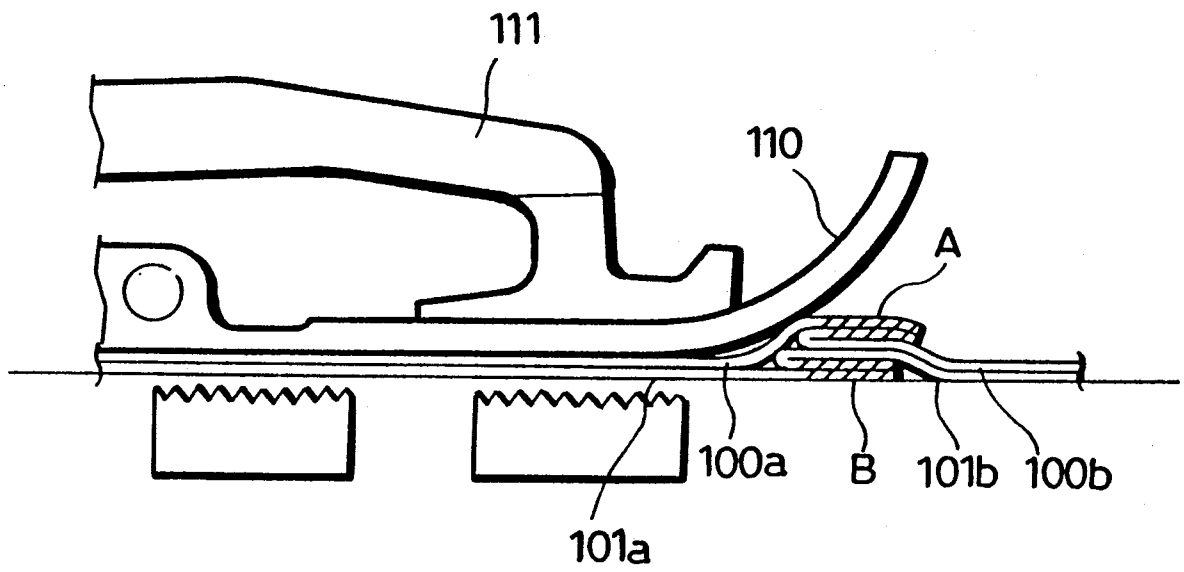
FIG. 4 Related Art
FIG. 4 is a cross sectional view of the unfinished trousers folded down immediately before the presser foot of the conventional automatic sewing apparatus.
Figure 5:
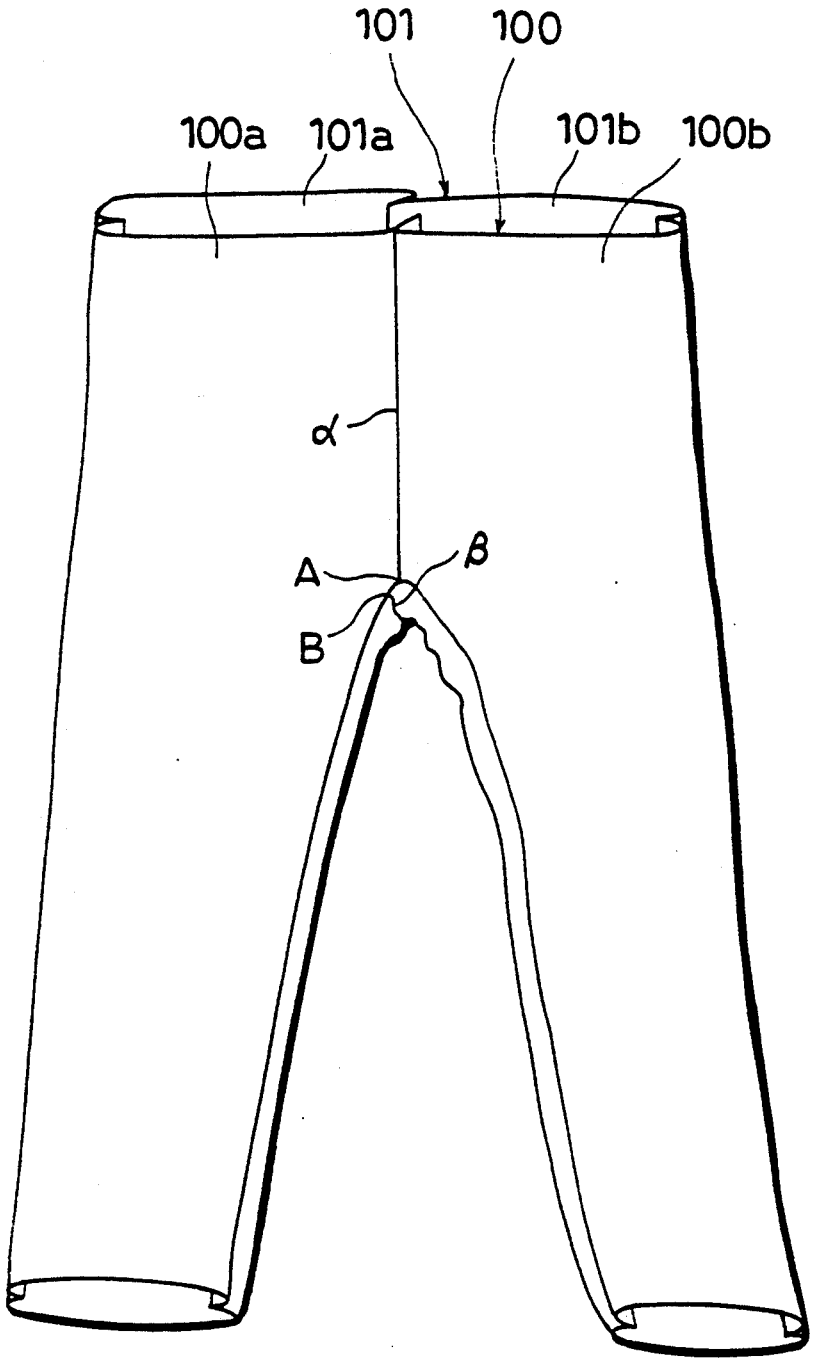
FIG. 5 Related Art
FIG. 5 is an illustration of the trousers which have been sewn by the conventional automatic sewing apparatus.
Figure 6:
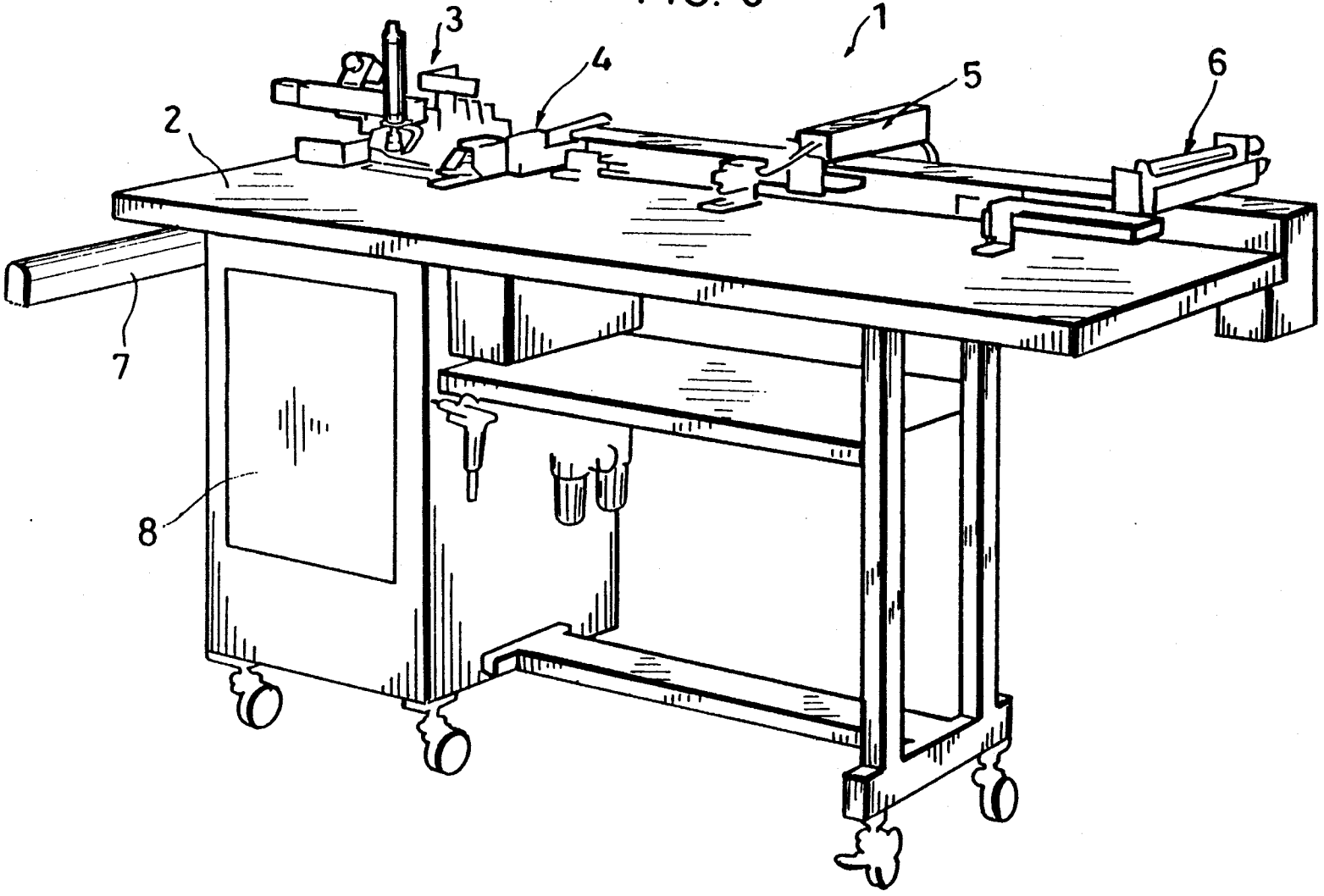
FIG. 6 is a perspective view of the outer construction of an automatic sewing apparatus of this invention.

As shown in FIG. 6, the automatic sewing apparatus 1 comprises a table 2 on which workpiece 85 for trousers (shown in FIG. 17) is laid and a sewing mechanism unit 3, a first hand 4, a second hand 5, and a third hand 6 mounted thereon in this order. It further comprises a stacker 7 to stack sewn workpiece, attached to the side of the table 2 and a controller 8 to control each of the units, provided beneath the table 2.

The sewing mechanism unit 3 includes an overedge sewing machine for sewing the workpiece 85.

The first hand 4 guides a pair of edges of the front and back bodies extending from the bottom of a leg sewn first to the center of the crotch of the workpiece 85 for trousers (hereinafter referred to as former half) to the sewing mechanism unit 3 while overlapping them.

The second hand 5 holds the center of the crotch while the former half is being sewn, and moves towards the sewing mechanism unit 3, applying proper tension to the workpiece 85 in accordance with the sewing operation. The hand 5 releases the holding operation when it approaches the sewing mechanism unit 3, and then guides a pair of edges of the front and back bodies extending from the center of the crotch to the bottom of the other leg of the workpiece 85 for trousers (hereinafter referred to as latter half) to the sewing mechanism unit 3, with overlapping them. The hand 5 also includes a sewn edge fold-down mechanism unit 33 which will be described later, to check the cloth being six-layered.

The third hand 6 holds the bottom of the latter half while the latter half is being sewn, moving towards the sewing mechanism unit 3 in accordance with the sewing operation.

The following is a detailed description of each of the above units.

Sewing mechanism unit

Figure 7:
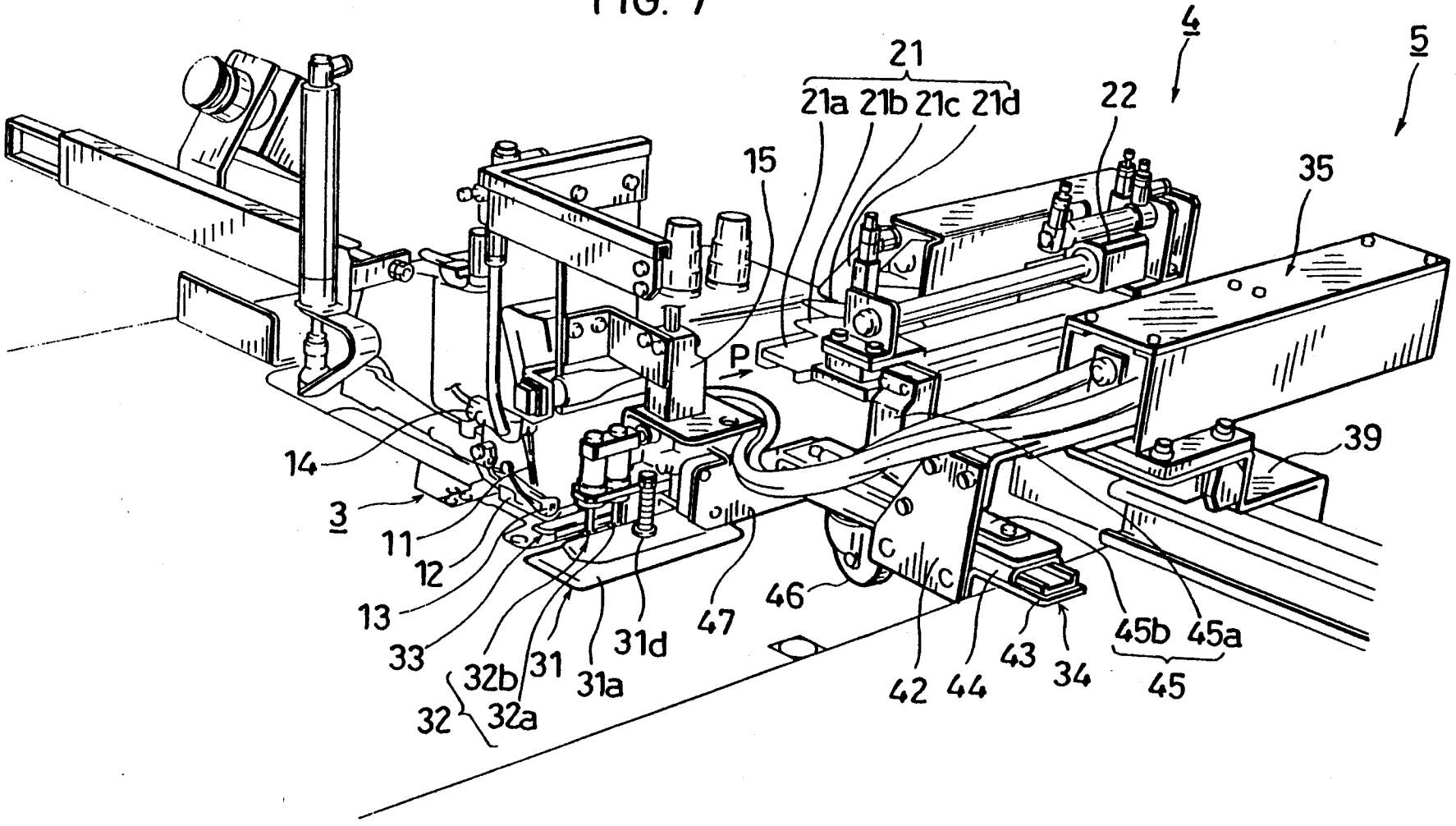
FIG. 7 is a perspective view of the first hand, the second hand, and the sewing mechanism unit to show their positional relationship and construction.
Figure 14:
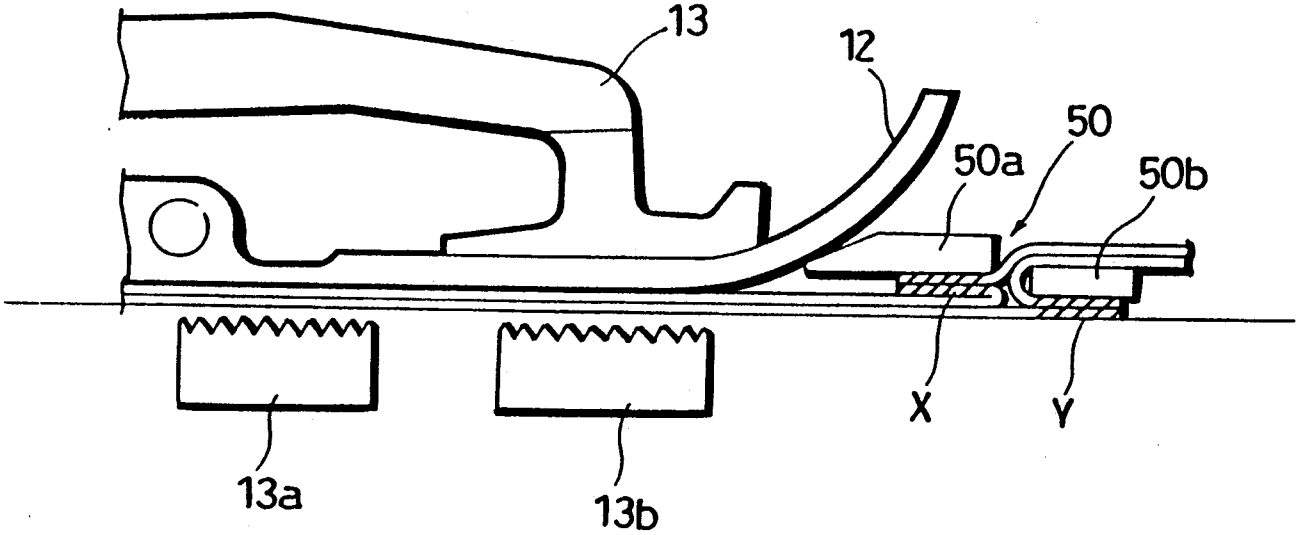
FIG. 14 is an illustration showing the unfinished trousers folded down when the fork member gets to just before the presser foot.

As shown in FIG. 7, the sewing mechanism unit 3 comprises a sensor 14 to detect that the cloth to be sewn is set on the needle drop point and another sensor 15 to detect that the second hand 5 has been arrived, in addition to essential components to be a sewing machine such as a needle 11, a presser foot 12, feed dogs 13, 13*a*, and 13*b* (whose overall construction is shown in FIG. 14), and a thread cutter (not shown).

First hand

The first hand 4 is mainly composed of a cloth guide mechanism unit 21 for guiding the workpiece 85 to the sewing mechanism unit 3 with the former half being overlapped and a hand reciprocation mechanism unit 22 for moving the cloth guide mechanism unit 21 back and forth.

The cloth guide mechanism unit 21 includes a base 21*a*, an inner lapper 21*b*, an outer lapper 21*c*, and a presser 21*d*.

The presser 21*d*, when pressed by an unillustrated air cylinder, presses the outer lapper 21*c* in order to press the front body sliding between the outer/inner lappers 21*b*/21*c* and the back body sliding between the inner lapper 21*b* and the base 21*a* without too much pressure to slide them smoothly.

Guide edges having different angles are formed at the tips of both inner/outer lappers 21*b*/21*c*, which guide the workpiece 85 to the sewing mechanism unit 3, by pulling the overlapped edges of its front/back bodies having different shapes in the direction shown an arrow P in FIG. 7.

The hand reciprocation mechanism unit 22 includes an air cylinder whose piston rod moves back and forth perpendicular to the direction of feed of the cloth. The piston rod is in an extended state while the former half is being sewn so as to position the cloth guide mechanism unit 21 near the presser foot 12. On the other hand, the cloth guide mechanism unit 21 is moved back when the second hand 5 has approached, near the end of the sewing of the former half, to avoid collision between them. (FIG. 7 shows the cloth guide mechanism unit 21 in a receded state)

Second hand

Figure 8:
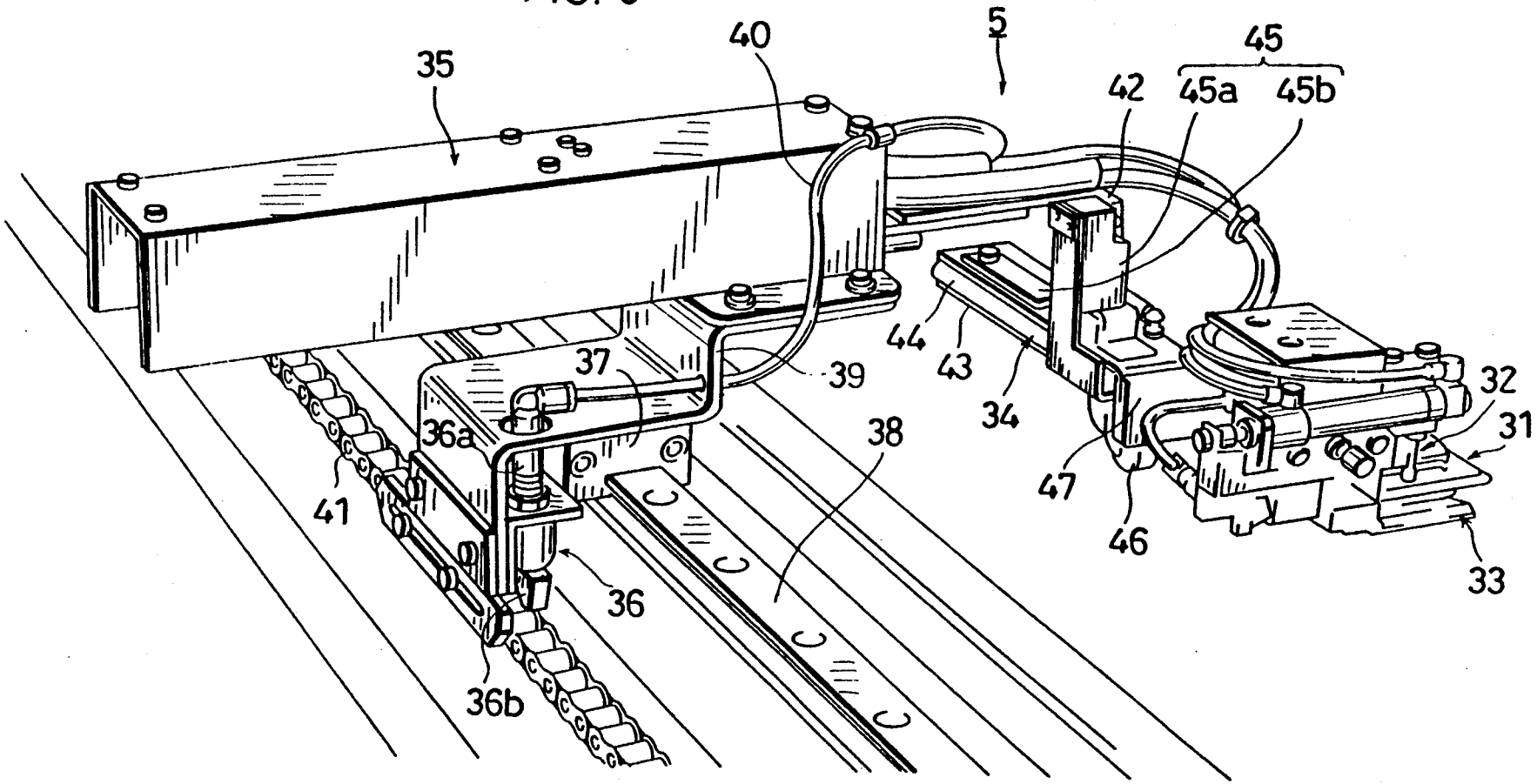
FIG. 8 is a perspective view of the second hand.

As shown in FIG. 8, the second hand 5 is mainly composed of a cloth guide mechanism unit 31, a cloth hold mechanism unit 32, a sewn edge fold-down mechanism unit 33, a tension detector 34, a hand reciprocation mechanism unit 35, a clutch mechanism unit 36, and a transit guide mechanism unit 37.

The tension detector 34, clutch mechanism unit 36, and transit guide mechanism unit 37 serve to move the second hand 5 while the former half is being sewn, following the workpiece 85 to be transferred.

The sliding transit guide mechanism unit 37 is provided on the rail 38 extending in the same direction as the feed of the workpiece 85 on the table 2. A double L-shaped angle member 39 is fixed on the transit guide mechanism unit 37, the clutch mechanism unit 36 being provided to the lower L-shaped portion and the hand reciprocation mechanism unit 35 being provided to the upper L-shaped portion.

The clutch mechanism unit 36 includes a cylinder 36*a* whose piston rod is move back and forth by air supplied from an air tube 40. By this movement, a wedge 36*b* fixed at the rod is driven between the rollers of a chain 41, or taken off. The chain 41 is transitted synchronously with the speed of cloth feed in the sewing mechanism unit. The second hand 5 can be transported by thus driving the wedge 36*b* in the chain 41, and can be stopped being transported by taking it off from the chain 41.

The tension detector 34 detects the tension which is applied to the former half while it is being sewn. According to the detected results, the clutch mechanism unit 36 is controlled and the transition of the second hand 5 is controlled thereby, which serves to maintain adequate tension. The tension detector 34 consists of a rail member 43 attached to an angle member 42 which is fixed on the hand reciprocation mechanism unit 35, a slide member 44 sliding on the rail member 43, a coil spring (not shown) to connect the rail member 43 and the slide member 44, a sensor set 45 composed of an access sensor 45*a* and a reflect board 45*b*, and a caster 46 to help the slide member 44 to slide smoothly.

The slide member 44 has the angle member 47 fixed thereon, by which the cloth guide mechanism unit 31, cloth hold mechanism unit 32, and sewn edge fold-down mechanism unit 33 are supported.

Figure 12:
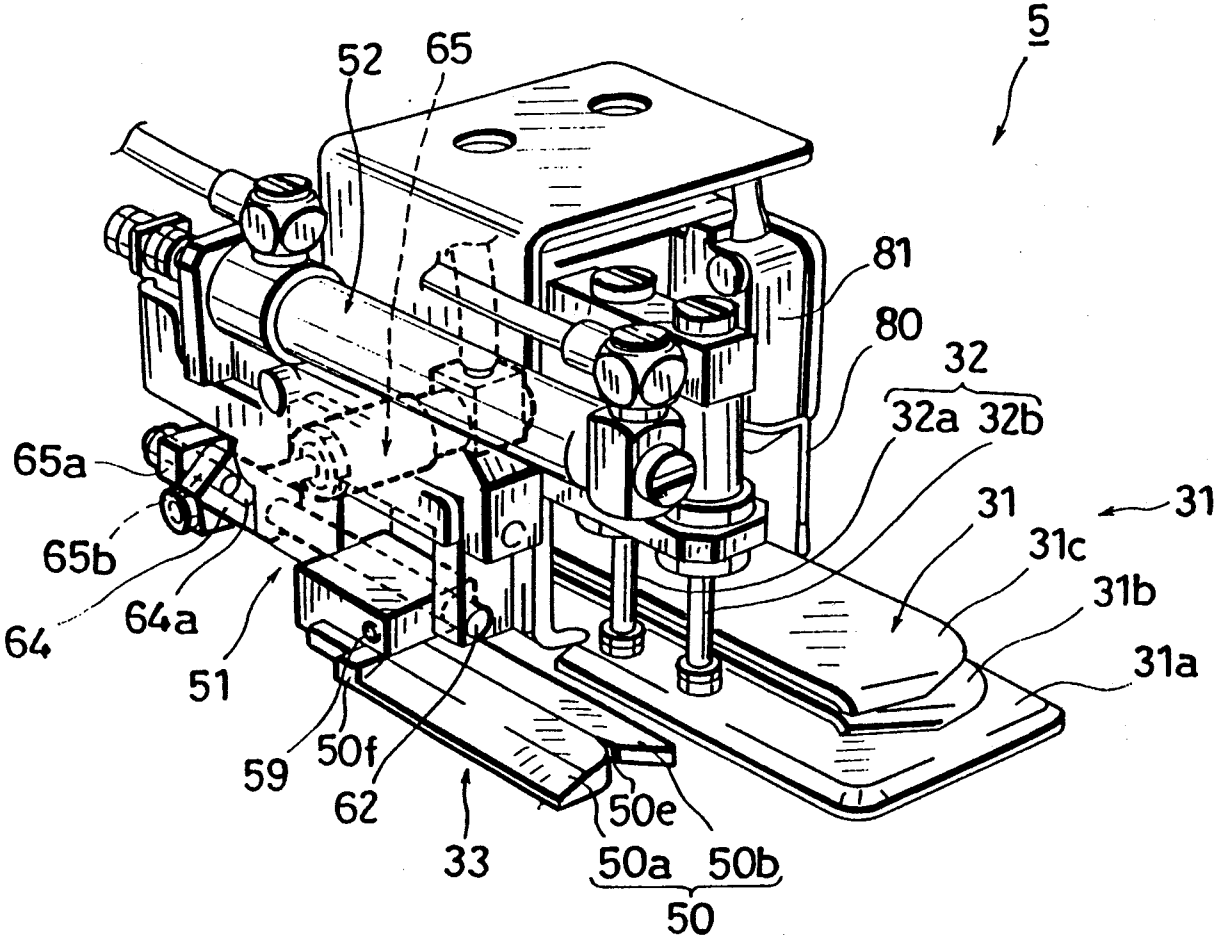
FIG. 12 is a perspective view showing the movement of the sewn edge fold-down mechanism unit in the second hand when the clothe has been set.

As shown in FIG. 12, the cloth hold mechanism unit 32 is composed of two air cylinders 32*a*/32*b*, whose piston rods extend to press the crotch center down with their tips while the former half is being sewn.

Figure 9:
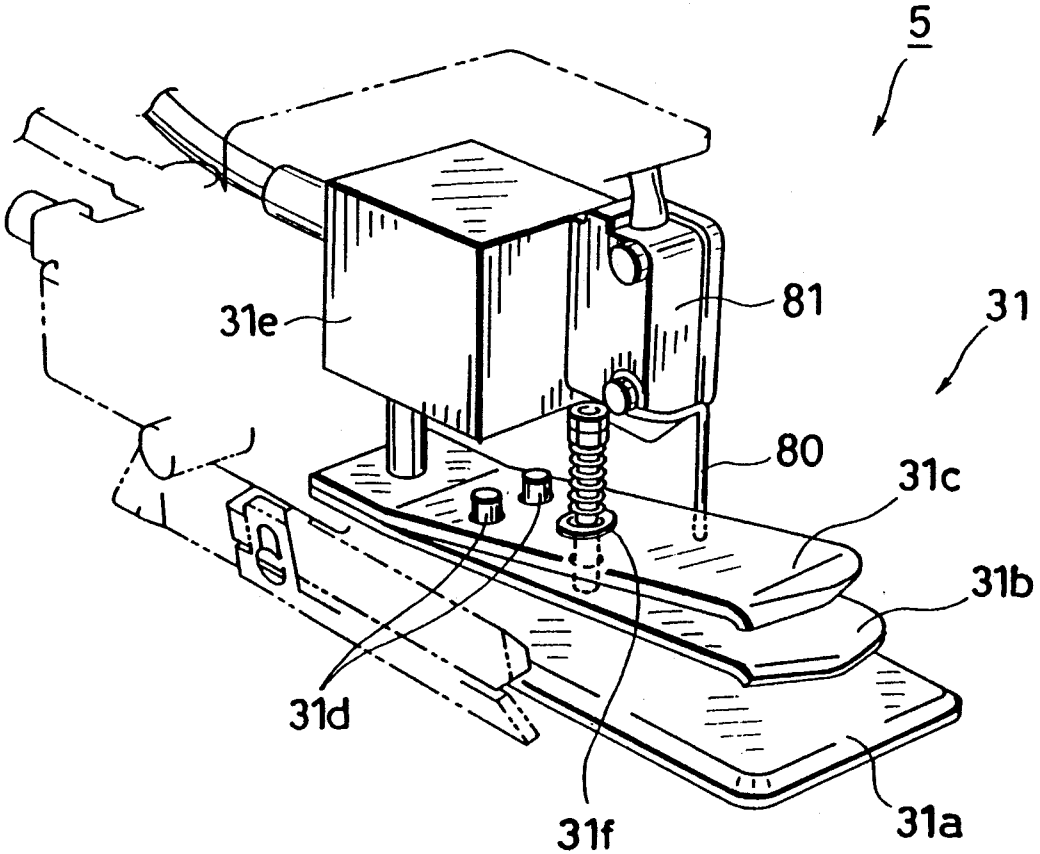
FIG. 9 is a perspective view precisely showing the cloth guide mechanism unit in the second hand.

The cloth guide mechanism unit 31, like the cloth guide mechanism unit 21 of the first hand 4, guides the latter half to the sewing mechanism unit 3 with overlapping them. As shown in FIG. 9, the cloth guide mechanism unit 31 is composed of a base 31*a*, a center guide 31*b*, a top guide 31*c*, a guide pin 31*d* for guiding the vertical reciprocation of the center guide 31*b* and the top guide 31*c*, an air cylinder 31*e* disposed behind the guide pin 31*d*, and a coil spring 31*f* disposed in front of the guide pin 31*d*. The center guide 31*b* and the top guide 31*c* are slightly bent behind the guide pin 31*d*. The workpiece 85 is held with adequate pressure by the coil spring 31*f* pressing the center guide 31*b* and the top guide 31*c*. On the other hand, it is released if the center guide 31*b* and the top guide 31*c* are raised along the guide pins 31*d* according to the rods of the air cylinder 31*e* which come down to press the ends of the guides 31*b*/31*c*.

The mechanism unit 31 is also provided with a switch 81 which has a feeler 80 to turn the switch 81 on by touching the workpiece 85 when it is set.

Figure 10:
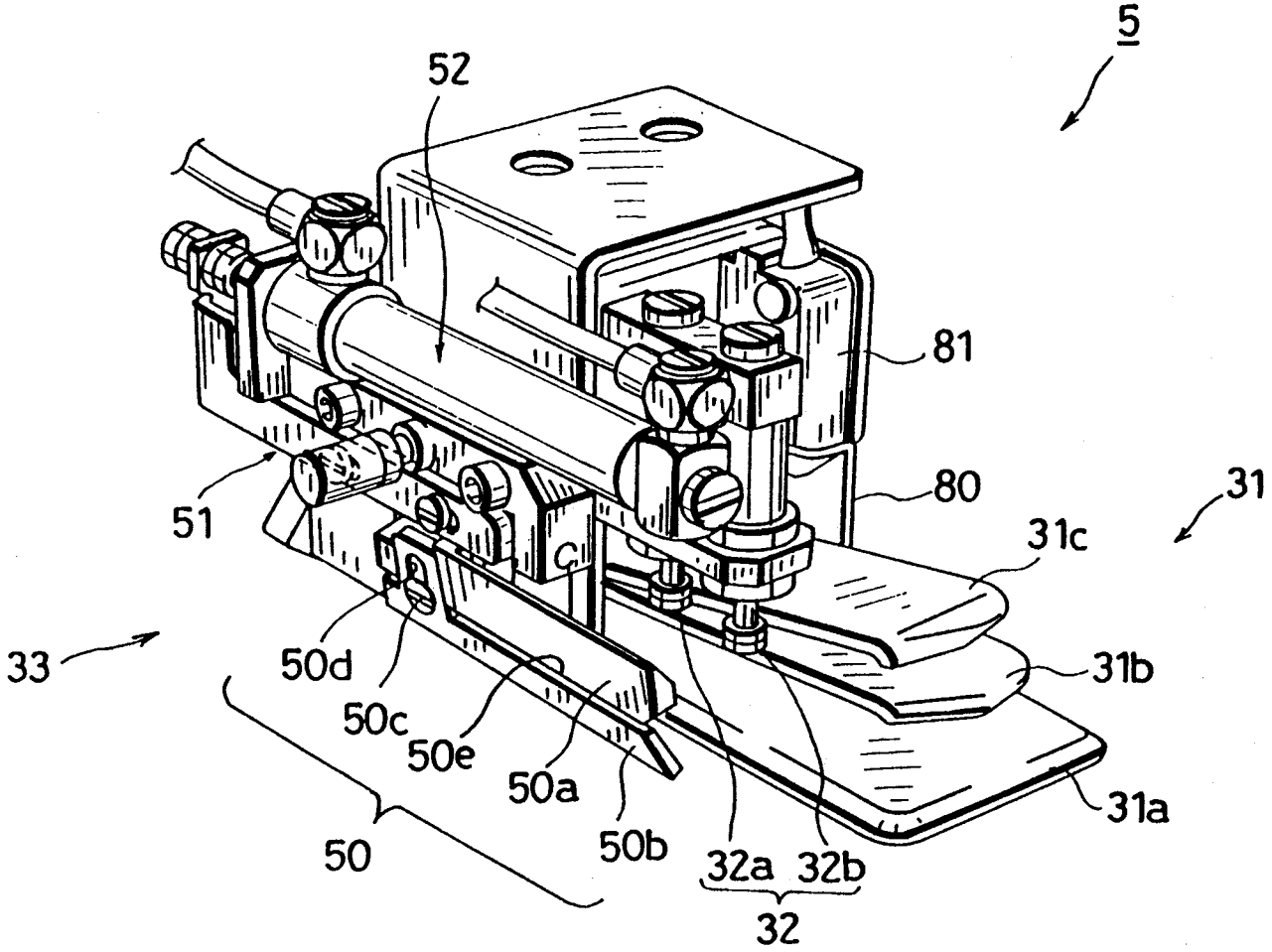
FIG. 10 is a perspective view showing the initial state of the sewn edge fold-down mechanism unit in the second hand before the cloth is set.

The sewn edge fold-down mechanism unit 33 preventing the cloth from being six-layered is provided with a fork member 50, a fork rotation mechanism unit 51, and a fork reciprocation mechanism unit 52 as shown in FIG. 10.

Figure 11:
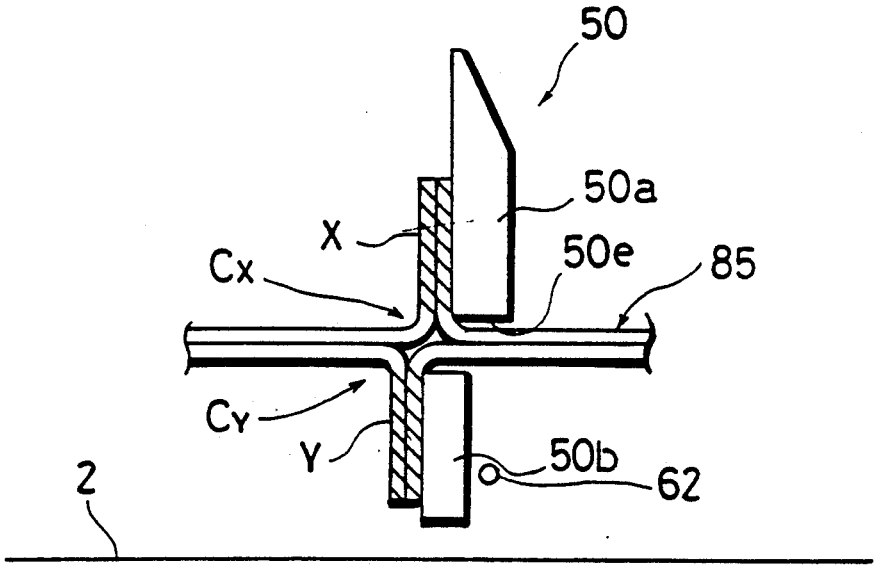
FIG. 11 is an illustration depicting a function of the fork member when a first finger is positioned above a second finger.
Figure 13:
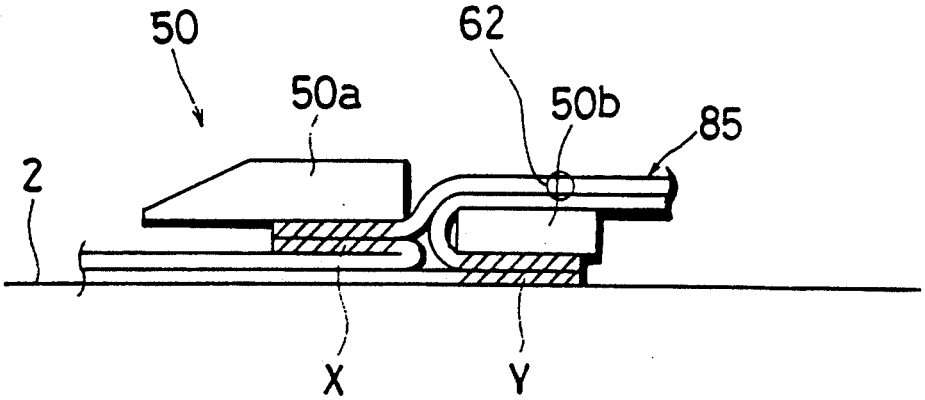
FIG. 13 is an illustration depicting a function of the fork member when both fingers are positioned level with each other.

The fork member 50 includes a pair of presser fingers 50*a*/50*b* having space 50*e* therebetween, into which corners $C_x$ and $C_y$ of the crotch of the workpiece 85 are slid by the operator. The presser fingers 50*a*/50*b* are tapered so that the space 50*e* can be wide enough for the workpiece 85 to be slided into. The fork member 50, after the workpiece 85 is slided into the space 50*e* as shown in FIG. 11, is rotated in an about 90° arc as shown in FIGS. 12 and 13 by the fork rotation mechanism unit 51 which will be described later. The presser finger 50*a* is tapering so that it can fit under the curling front end of the presser foot 12 as shown in FIG. 14.

In this embodiment, the fork member 50 is composed of the presser finger 50*a* and the other presser finger 50*b* having a long hole 50*d*, both of which are screwed by a screw 50*c* as shown in FIG. 10. Such a construction makes the width of the space 50*e* adjustable. By putting a spacer (not shown) between the screwed portion of the fingers 50*a* and 50*b*, a difference in level is provided to the bottom surfaces of the fingers 50*a*/50*b* according to the thickness of the cloth. Thus, the fingers become applicable to various cloth with different thicknesses by exchanging the spacer with another having a different thickness.

Figure 15:
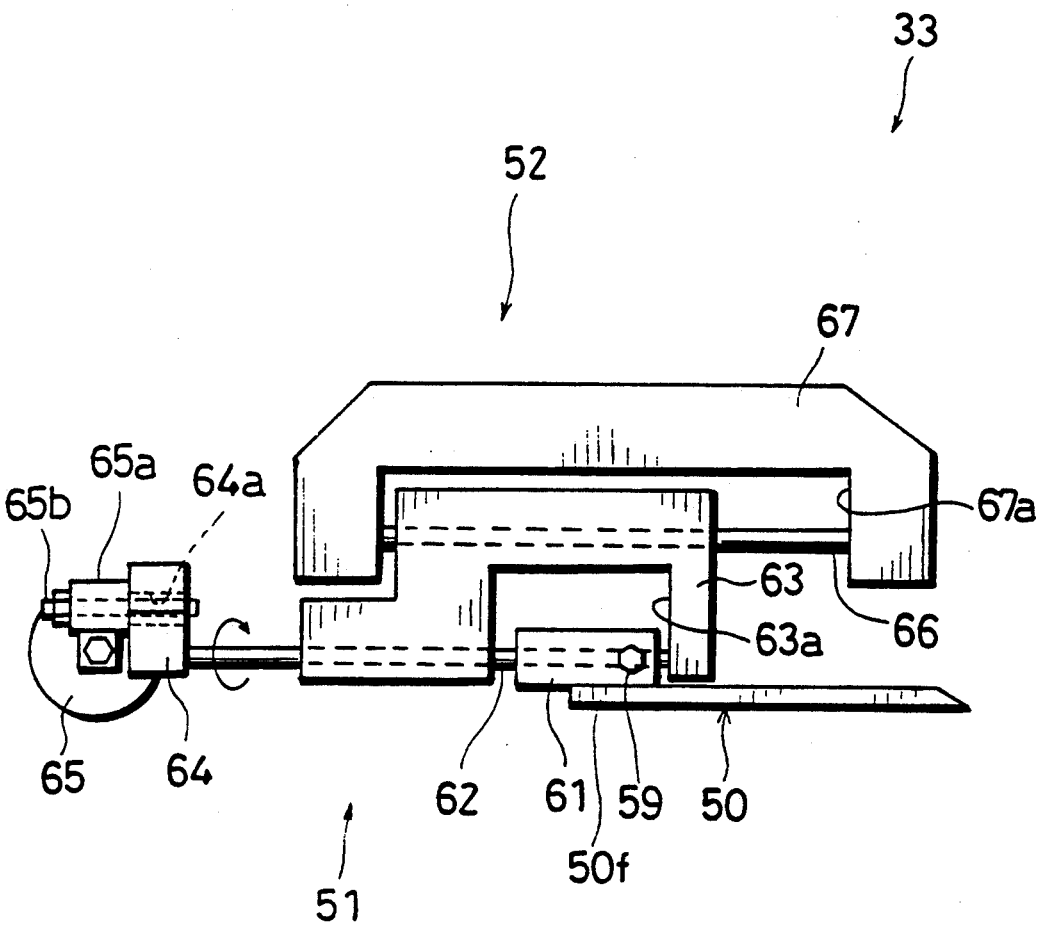
FIG. 15 is an overall side view of the fork rotation mechanism unit and the hand reciprocation mechanism unit in the second hand.

A block 61 is fixed to the base of the fork member 50 which is disposed inside a space 63*a* with a rotation axis 62 in a rotation axis supporter 63 as shown in FIG. 15. The block 61 is fixed on one end of the rotation axis 62 by a screw 59. The position of the rotation axis 62 in the block 61 is predetermined so that enough space for about two thicknesses of the cloth can be formed between the bottom surface of the presser finger 50*b* and the table 2 as shown in FIG. 13 when both fingers 50*a*/50*b* are positioned level with each other. The rotation axis 62 may be positioned in the space if it is in the position to press the cloth onto the table when it rotates. The rotation axis 62 has a lever 64 fixed at the other end thereof as shown in FIGS. 12 and 15. The lever 64 has a long hole 64*a* into which a drive pin 65*b* of the block 65*a* is set which is fixed at the tip of the rod of the fork rotation cylinder 65. The fork member 50 thus constructed can be rotated by the reciprocation of the rod of the fork rotation cylinder 65.

Figure 16:
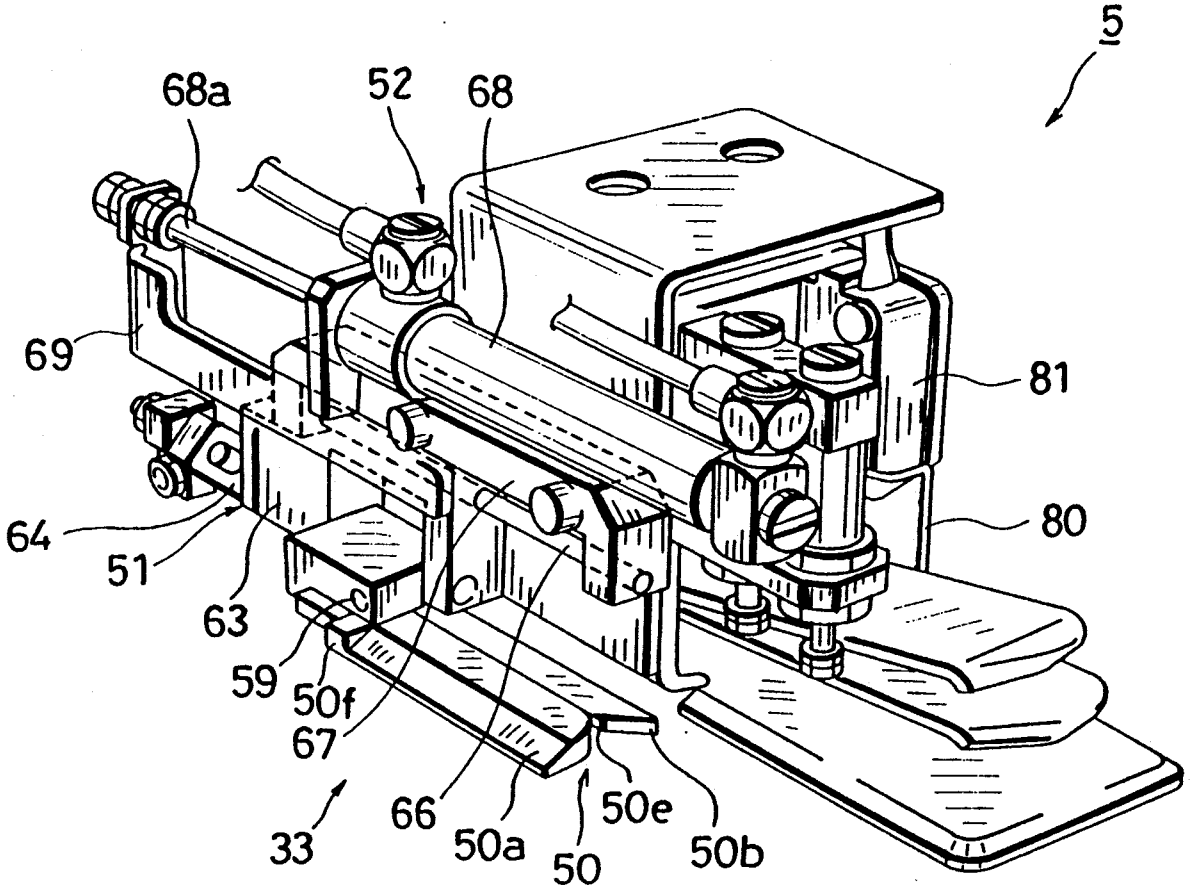
FIG. 16 is a detailed perspective view showing the movement of the fork reciprocation mechanism unit in the second hand before the second hand recedes.

The fork reciprocation mechanism unit 52 serves to move the fork member 50 back immediately before the sewn ends are fed to the sewing mechanism unit 3. The mechanism unit 52 is provided with a guide axis supporter 67 having a space 67*a* in which a guide axis 66 to support the rotation axis supporter 63 is provided. The length of the space 67*a* is equal to the total length of that of the rotation axis supporter 63 and the range of reciprocation of the fork member 50. The guide axis supporter 67 is provided with a cylinder 68 whose piston rod 68*a* moves back and forth in the same direction as the guide axis 66 as shown in FIG. 16. The tip of the rod 68*a* of the cylinder 68 is coupled with the rotation axis supporter 63 by a bracket 69. The fork member 50 and the fork rotation mechanism unit 51 are moved back and forth by the cylinder 68.

As shown in FIG. 7, the hand reciprocation mechanism unit 35 includes a square frame, and an air cylinder disposed therein which moves back and forth perpendicular to the direction of feed of the cloth. This mechanism unit 35, like the hand reciprocation mechanism unit 22 of the first hand 4, moves the cloth guide mechanism unit 31 from near the presser foot 12 to the position where the collision with the third hand 6 can be avoided.

Third hand

The third hand 6 keeps holding the bottom end of the latter half until it reaches just before the sewing mechanism unit 3, following the workpiece 85 transferred by the sewing operation of the sewing mechanism unit 3. The construction of this hand is not described because it is equal to conventional auto sewing apparatuses.

Operation and usage of the auto sewing apparatus

Figure 17:
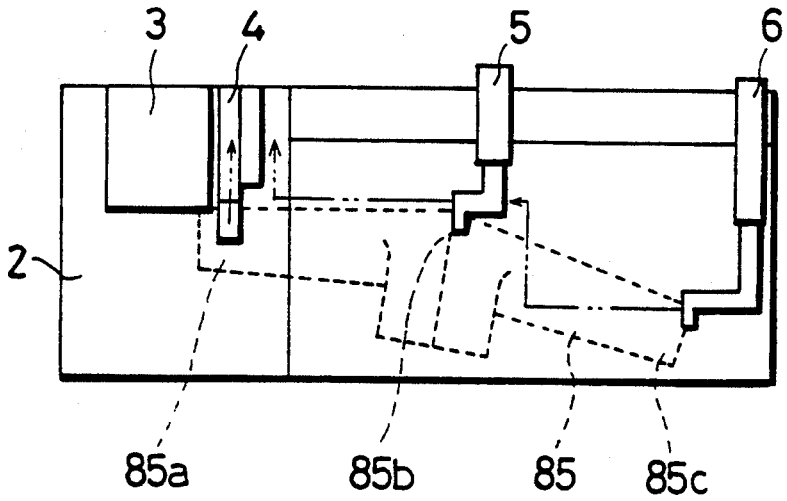
FIG. 17 is a top view showing the state that the unfinished trousers is set.

The first, second, and third hands of the automatic sewing apparatus are positioned as shown in FIG. 17 before the sewing operation starts.

At first, an operator sets the bottom 85*a* of the workpiece 85 under the sewing mechanism unit 3 and the first hand 4. The setting is detected by the sensor 14 of the sewing mechanism unit 3, and then cloth holding operation by the cloth guide mechanism unit 21 and the like are performed.

Each unit of the second hand 5 is first set as shown in FIG. 10. More precisely, in the cloth guide mechanism unit 31, the center guide 31*b* and top guide 31*c* are in an open state so that the cloth can be slided between them. In the cloth hold mechanism unit 32, both air cylinders 32*a*/32*b* stay above so that the cloth can be slid under the rods. In the fork reciprocation mechanism unit 52, the fork member 50 is positioned beside the cloth hold mechanism unit 32. In the fork rotation mechanism unit 51, the presser finger 50*a* is positioned substantially above the other presser finger 50*b* so that the cloth can be slid into the space 50*e*.

Under such initial conditions, as shown in FIG. 11, the operator slides the crotch 85*b* of the workpiece 85 into the space 50*e* and between the guides 31*a*/31*b*/31*c* of the cloth guide mechanism unit 31, applying sewn margins X and Y of the crotch 85*b* to the presser fingers 50*a*/50*b* to coincide substantially the corners $C_x/C_y$, of the crotch 85*b*. The safe sliding is detected by the switch 81 being turned on when the feeler 80 touches the cloth, and then sequent operations are performed. More precisely, as shown in FIG. 12, in the cloth guide mechanism unit 31, the center guide 31*b* and the top guide 31*c* close to each other to hold the cloth (not shown). In the cloth hold mechanism unit 32, both piston rods of the air cylinders 32*a*/32*b* come down to hold the cloth (not shown). In the fork rotation mechanism unit 51, the fork member 50 is rotated so that the presser fingers 50*a*/50*b* become level with each other. According to this rotation of the member 50, the end X is folded down in the direction of feed of the cloth, and the end Y in the opposite direction as shown in FIG. 13.

The operator sets the bottom 85*c* of the workpiece 85 under the third hand 6, thereby the bottom 85*c* being held and sewing operation being started.

After the sewing operation is started, the cloth guide mechanism unit 21 of the first hand 4 guides the former half of the workpiece 85 to the sewing mechanism unit 3. The second hand 5 follows the workpiece 85 as it is transferred to be sewn. More precisely, at first the slide member 44 moves in accordance with the transfer of the workpiece 85. As a result, it gradually slides on the rail member 43. When the amount of this sliding reaches a specified amount, it is detected by the sensor set 45, and the wedge 36*b* of the clutch mechanism unit 36 is driven in the chain 41. Consequently the second hand 5 and the third hand 6 move towards the sewing mechanism unit 3.

When the sewing operation proceeds as far as the crotch 85*b* and the second hand 5 gets close to the first hand 4, the closeness is detected by the sensor 15 of the sewing mechanism unit 3 and the first hand 4 is moved back by the hand reciprocation mechanism unit 22 to avoid collision with the second hand 5.

Furthermore, when the fork member 50 of the second hand 5 reaches just before the presser foot 12 as shown in FIG. 14, the receding operation of the fork reciprocation mechanism unit 52 moves the member 50 back to the position where it does not touch the presser foot 12. If the fork member 50 is moved back at this moment, the folding down operation of the end X is released. However, the standing up of the end X is prevented because it crawls under the presser foot 12. Therefore, the number of layered cloth changes from two to four, and then four to two.

After the fork member 50 is moved back, its presser fingers 50*a*/50*b* are again positioned vertical, by the fork rotation mechanism unit 51. At the same time, the holding by the cloth hold mechanism unit 32 is released and the transition of the second hand 5 is stopped. However, the cloth guide mechanism unit 31, in place of the cloth guide mechanism unit 21 of the first hand 4, guides the latter half to the sewing mechanism unit 3 with the center guide 31*b* and top guide 31*c* closed.

The third hand 6 moves towards the sewing mechanism unit 3, while applying adequate tension to the latter half. When the third hand 6 has approached the second hand 5, the second hand 5 is moved back by the hand reciprocation mechanism unit 35 when the sewing operation is approaching the bottom 85*c*, to avoid collision with the third hand 6.

When all the sewing operation is completed, the first, second, third hands 4, 5, and 6 get back to their own initial positions.

Figure 18:
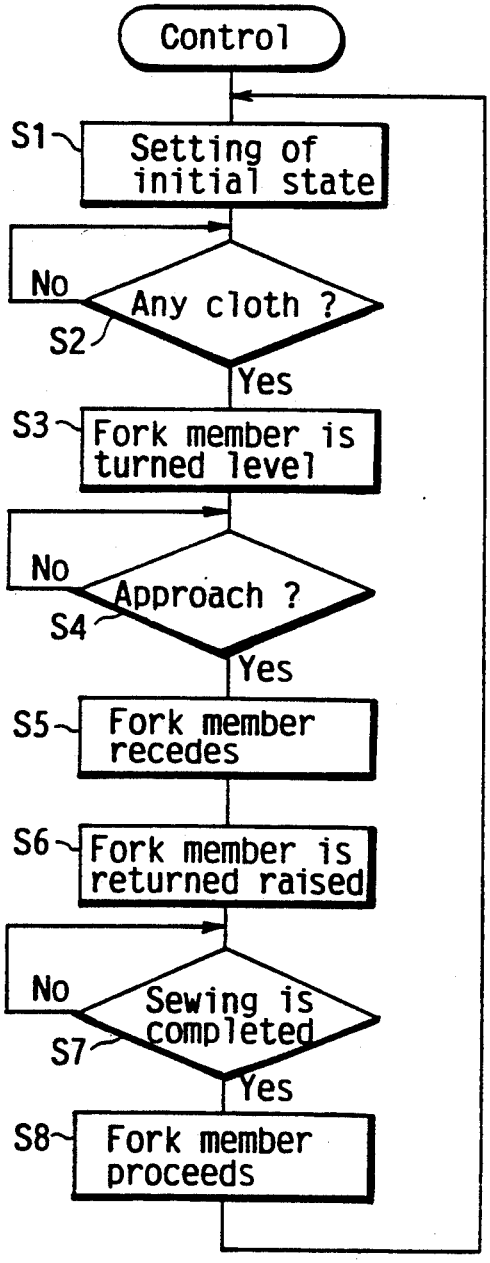
FIG. 18 is a flow chart depicting the control of the controller.

The following is a brief description of the operation of the sewn edge fold-down mechanism unit 33 under the control of the controller 8. As shown in FIG. 18, after each unit of the sewn edge fold-down mechanism unit 33 is initialized (S1), the setting of the cloth is detected by the switch 81 (S2), and the fingers 50*a*/50*b* of the fork member 50 are turned to horizontal posture by the fork rotation mechanism unit 51 (S3). After that, when the approach of the fork member 50 to the presser foot 12 is detected by the sensor 15 (S4), it is moved back by the fork reciprocation mechanism unit 52 (S5) and raised vertically by the fork rotation mechanism unit 51 (S6). Then, whether the sewing operation is completed or not is judged (S7), and if it is, the fork member 50 is moved forward (S8) to resume the operation in S1.

As described hereinbefore, according to the automatic sewing apparatus of this invention, at most four layers as opposed to the customary six layers are sewn together. Such a lessening of the thickness of the cloth serves to reduce the load applied on the sewing mechanism unit.

The lessening of the thickness also reduces the resistance of the pressor foot 12, thereby preventing the slip of the end X. The slip of the end X which is folded down in the direction of feed of the cloth is more surely checked by the end Y which is folded down in the opposite direction.

Consequently, both seaming lines of the right/left front bodies and of the right/left back bodies in a pair of trousers as a sewn product form a straight line. Therefore, trousers with good appearance and comfortable fitting can be provided.

In this embodiment, a difference in level is provided according to the thickness of the cloth to the bottom surface of the presser fingers 50*a*/50*b* of the fork member 50 by providing a spacer therebetween.

However, the presser fingers 50*a*/50*b* can be united and made adjustable to different thicknesses of cloth by being exchanged with a prepared fork member having a difference in level. Or, it can be dispensed with when, for example, the cloth is thin.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An automatic sewing apparatus useful for sewing together a pair of first edges of two overlapped bodies, each of said overlapped bodies having been formed by sewing together a pair of second edges of two pieces of overlapped cloth, the sewn pair of second edges of each of the overlapped bodies intersecting the first edge of the respective overlapped body, each of the pairs of second edges forming a corner at the intersection with the first edge, the two overlapped bodies being layered one above the other with the sewn pairs of second edges extending away from each other and the first edge and the sewn pair of second edges of one of the overlapped bodies being directly above the first edge and the sewn pair of second edges of the other overlapped body, the apparatus comprising:

sewing means for sewing the first edges;

a table for supporting the bodies to be sewn by the sewing means, the bodies to be sewn being fed along the table to the sewing means; and sewn edge fold-down means for folding down said sewn pair of second edges at the corner of one of the bodies on top of the bodies in the direction of feeding the cloth to the sewing means, and for folding said sewn pair of second edges at the corner of the other body beneath the bodies in the opposite direction, before the first edges are sewn by said sewing means.

2. An automatic sewing apparatus of claim 1, wherein the sewn edge fold-down means comprises:

a fork having first and second fingers for holding individually each of said sewn corners of the two bodies; and rotation means for rotating the fork between a vertical state in which the first finger is above the second finger and a horizontal state in which both of said fingers are level with each other.

3. An automatic sewing apparatus of claim 2, wherein the rotation means has a rotation axis so that the pairs of second edges can be made to substantially be one above the other by fitting both of the pairs of second edges on a sewing means side of the fingers when the fork is in the vertical state and inserting the overlapped bodies between the fingers, and said pairs of second edges at the corners can be folded down onto the table when the fork is in the horizontal state by rotating the rotation axis.

4. An automatic sewing apparatus of claim 3, wherein the sewing means includes an upwards-curving presser foot for pressing down the bodies onto the table, and the first finger is tapered towards the sewing means opposite to the upwards-curved portion of the presser foot.

5. An automatic sewing apparatus of claim 1, further comprising:

a first hand which guides a first portion of the pair of first edges to be sewn, which extends from the sewing start point of the first edges to the corners at which the pairs of second edges intersect the first edges, to the sewing means;

a second hand which moves towards the sewing means, following the advance of the bodies while holding the corners while the first portion is sewn, which stops moving and releases the holding of the bodies when the sewing of the first portion has been completed, and which guides a second portion of the pair of first edges to be sewn, which extends from the corners to the sewing end portion of the first edges; and a third hand which moves towards the sewing means, following the advance of the bodies while holding the end point while the second portion is being sewn;

wherein the sewn edge fold-down means is included with the second hand.

6. An automatic sewing apparatus of claim 5, wherein the second hand further comprises:

fork reciprocation means for moving the fork to an extended position to set the bodies into the fork, and to a recessed position to prevent the fork from interfering with the presser foot.

7. An automatic sewing apparatus of claim 6, further comprising:

control means for controlling the rotation means and the fork reciprocation means so that the fork can be moved to the extended position and rotated to the position in which the first finger is above the second finger when the bodies are set to the fork, can be rotated for both fingers to be level with each other when the bodies have been set, and can be moved to the recessed position when the fork has approached the presser foot.

8. An automatic sewing apparatus of claim 7, further comprising a sensor for detecting that the cloth has been set to the fork, wherein the control means actuates rotation of the fork so that both fingers can be level with each other according to a detecting signal from the sensor.

9. An automatic sewing apparatus for forming a cross seam over two pieces of overlapped bodies, each of the bodies being formed from two pieces of cloth by forming a plain seam over edges of the two pieces, the two pieces of overlapped bodies being layered with margins of the plain seam facing away from each other and the plain seams being arranged so that one lies directly above the other, comprising:

a sewing machine for forming the cross seam;

a table for supporting the bodies to be sewn by the sewing machine, the bodies to be sewn being fed to the sewing machine along the table; and a hand for folding two pieces of layered bodies before they are sewn by the sewing machine, wherein the hand includes a fork horizontally supported for holding individually each margin formed by the plain seam of the two pieces of the layered bodies, and rotation means for rotating the fork around a horizontal axis.

10. An automatic sewing apparatus useful for sewing together a pair of first edges of two overlapped bodies, each of said overlapped bodies having been formed by sewing together a pair of second edges of two pieces of overlapped cloth, the sewn pair of second pair of each of the overlapped bodies intersecting the first edge of the respective overlapped body, each of the pairs of second edges forming a corner at the intersection with the first edge, the two overlapped bodies being layered one above the other with the sewn pairs of second edges extending away form each other and the first edge and the sewn pair of second edges of one of the overlapped bodies being directly above the first edge and the sewn pair of second edges of the other overlapped body, the apparatus comprising:

sewing means for sewing the first edges;

a table for supporting the bodies to be sewn by the sewing means, the bodies to be sewn being fed along the table to the sewing means; and sewn edge fold-down means for folding down said sewn pair of second edges at the corner of one of the bodies on top of the bodies in the direction of feeding the cloth to the sewing means, and for folding said sewn pair of second edges at the corner of the other body beneath the bodies in the opposite direction, before the corners are sewn by said sewing means.

11. An automatic sewing apparatus for forming a cross seam over two pieces of overlapped bodies, each of the bodies being formed from two pieces of cloth by forming a plain seam over edges of the two pieces, the two pieces of overlapped bodies being layered with margins of the plain seam facing away from each other and the plain seams being arranged so that one lies directly above the other, comprising:

a sewing machine for forming the cross seam;

a table for supporting the bodies to be sewn by the sewing machine, the bodies to be sewn being fed to the sewing machine along the table; and a hand for folding two pieces of layered bodies before the cross seam is formed at the plain seams, wherein the hand includes a fork horizontally supported for holding individually each margin formed by the plain seam of the two pieces of the layered bodies, and rotation means for rotating the fork around a horizontal axis.

* * * * *